US011476617B2

(12) United States Patent
Schuetz et al.

(10) Patent No.: US 11,476,617 B2
(45) Date of Patent: Oct. 18, 2022

(54) CONNECTION RELEASE

(71) Applicant: Raffel Systems, LLC, Germantown, WI (US)

(72) Inventors: Bailey Schuetz, Germantown, WI (US); Edward A. Nowak, West Bend, WI (US); Jeff Malinowski, Slinger, WI (US)

(73) Assignee: Raffel Systems, LLC, Germantown, WI (US)

( * ) Notice: Subject to any disclaimer, the term of this patent is extended or adjusted under 35 U.S.C. 154(b) by 0 days.

(21) Appl. No.: 17/206,304

(22) Filed: Mar. 19, 2021

(65) Prior Publication Data

US 2022/0302641 A1 Sep. 22, 2022

(51) Int. Cl.
*H01R 13/62* (2006.01)
*H01R 13/422* (2006.01)
*H01R 13/639* (2006.01)

(52) U.S. Cl.
CPC ..... *H01R 13/62* (2013.01); *H01R 13/422* (2013.01); *H01R 13/6392* (2013.01)

(58) Field of Classification Search
CPC ..... H01R 13/6392
USPC ..... 439/369
See application file for complete search history.

(56) References Cited

U.S. PATENT DOCUMENTS 5,382,179 A * 1/1995 Noschese ..... H01R 13/6275 439/369

* cited by examiner

*Primary Examiner* — Ross N Gushi
(74) *Attorney, Agent, or Firm* — Casimir Jones, S.C.; Brian F. Bradley

(57) ABSTRACT

A connection comprising a first plug having a first post and a conductor, a second plug having a second post and an aperture configured to receive the conductor, and a connector. The connector includes a first slot and a second slot. The first slot includes a first opening, a first protrusion, and a first end opposite the first opening, and the second slot includes a second opening, a second protrusion, and a second end opposite the second opening. The first slot is configured to at least partially receive the first post and the second slot is configured to at least partially receive the second post. The first post is positioned between the first end and the first protrusion of the first slot, and the second post is positioned between the second end and the second protrusion of the second slot.

23 Claims, 2 Drawing Sheets

CONNECTION RELEASE

TECHNICAL FIELD

The present disclosure relates to electrical connections, and more particularly to electrical connections for DC voltage.

BACKGROUND

Connection of cords, for example electrical cords, are conventionally locked or abutted together. Locked connections create trip hazards and can damage cords by failing to disconnect when a force is applied to the connection. Abutted connections can fail to maintain a secure connection during normal operation by becoming loose in response to small forces or minor disturbances.

SUMMARY

The disclosure provides, in one aspect, a connection comprising a first plug having a first post and a conductor, a second plug having a second post and an aperture configured to receive the conductor, and a connector. The connector includes a first slot and a second slot. The first slot includes a first opening, a first protrusion, and a first end opposite the first opening, and the second slot includes a second opening, a second protrusion, and a second end opposite the second opening. The first slot is configured to at least partially receive the first post and the second slot is configured to at least partially receive the second post. The first post is positioned between the first end and the first protrusion of the first slot, and the second post is positioned between the second end and the second protrusion of the second slot.

Other aspects of the disclosure will become apparent by consideration of the detailed description and accompanying drawings.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

Figure 1:
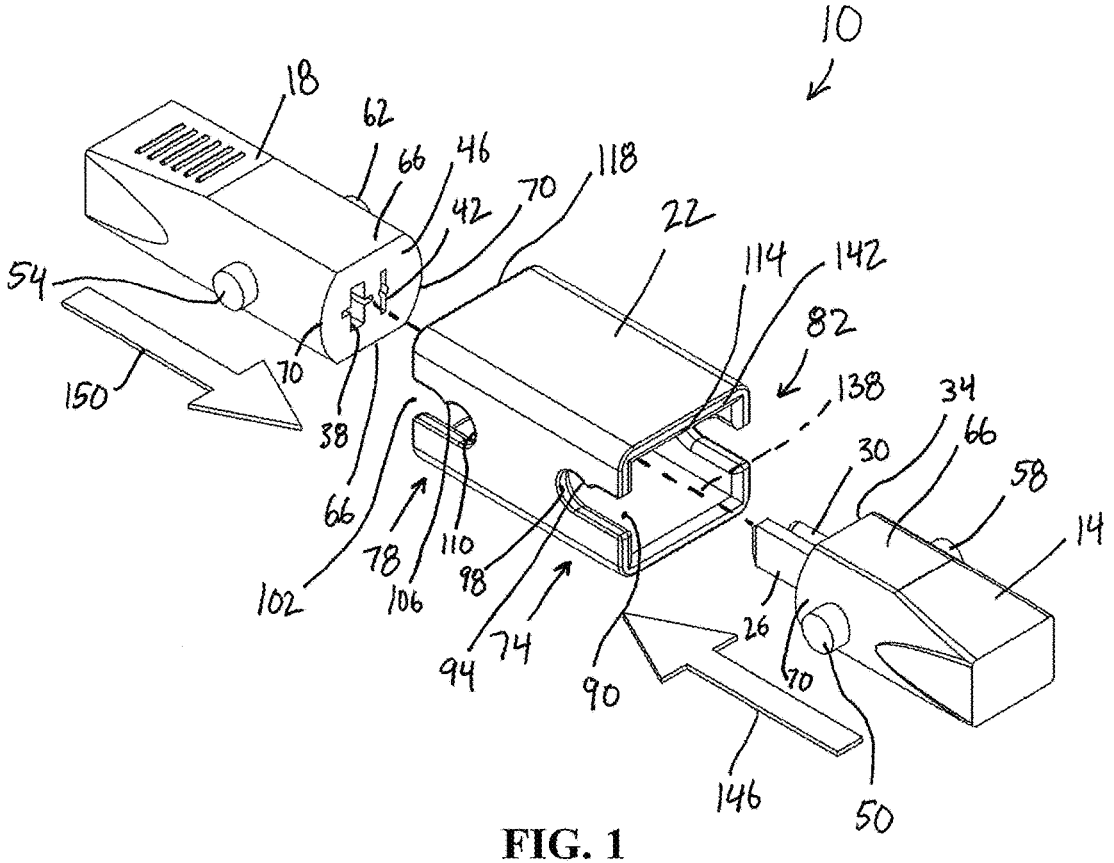
FIG. 1 is an exploded view of a connection in a disconnected configuration.
Figure 2:
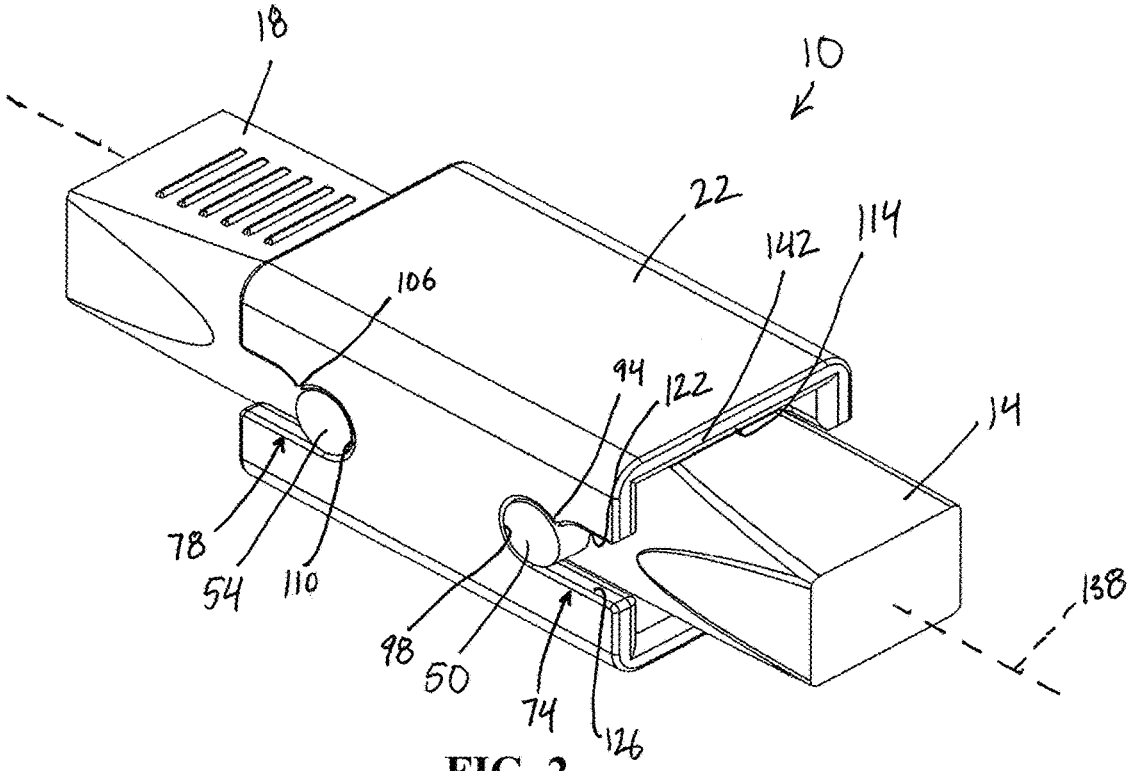
FIG. 2 is a perspective view of the connection of FIG. 1 in a connected configuration.

With reference to FIGS. 1 and 2, a connection 10 is illustrated in a disconnected configuration in FIG. 1 and in a connected configuration in FIG. 2. The connection 10 includes a first plug 14 (i.e., a male plug), a second plug 18 (i.e., a female plug), and a connector 22. In the illustrated embodiment, the connection 10 is an electrical connection and the plugs 14, 18 are coupled to corresponding electrical cords (not shown). In some embodiments, the connection 10 is a DC power connection (i.e., the first plug 14 and the second plug 18 are DC power plugs). The DC power connection may be mid-range DC voltage (e.g., within a range of approximately 5 V to approximately 29 V) or other voltage (e.g., greater than 29 V or lower than 5 V). In some embodiments, the connection 10 is utilized in motion furniture electronics, for example.

With continued reference to FIG. 1, the first plug 14 includes first conductor 26 and a second conductor 30 extending from a first mating surface 34. In the illustrated embodiment, the first conductor 26 and the second conductor 30 are DC power conductors. The second plug 18 includes a first aperture 38 and a second aperture 42 formed in a second mating surface 46. In the illustrated embodiment, the first aperture 38 is configured to receive the first conductor 26 and the second aperture 42 is configured to receive the second conductor 30. In the disconnected configuration (FIG. 1), the first and second conductors 26, 30 are separated from (i.e., disconnected from) the first and second aperture 38, 42. In the connected configuration (FIG. 2), the first and second conductors 26, 30 are received within (i.e., connected to) the first and second aperture 38, 42, respectively. In the connected configuration, the first plug 14 and the second plug 18 are electrically connected, and the mating surfaces 34, 46 are abutting. In the disconnected configuration, the first plug 14 and the second plug 18 are electrically disconnected, and the mating surfaces 34, 46 are spaced apart.

With continued reference to FIG. 1, the first plug 14 includes a first post 50 and the second plug 18 includes a second post 54. In the illustrated embodiment, the first plug 14 also includes a third post 58 and the second plug 18 also includes a fourth post 62. The first post 50 and the third post 58 are spaced from the first mating surface 34. Likewise, the second post 54 and the fourth post 62 are spaced from the second mating surface 46. In the illustrated embodiment, the first plug 14 and the second plug 18 include planar side surface 66 and arcuate side surfaces 70. The post 50, 54, 58, 62 are positioned on the arcuate side surfaces 70 of the plugs 14, 18. In the illustrated embodiment, the posts 50, 54, 58, 62 are cylindrical-shaped. In other embodiments, the posts are rectangular, oblong, or any other suitable shape.

Figure 3:
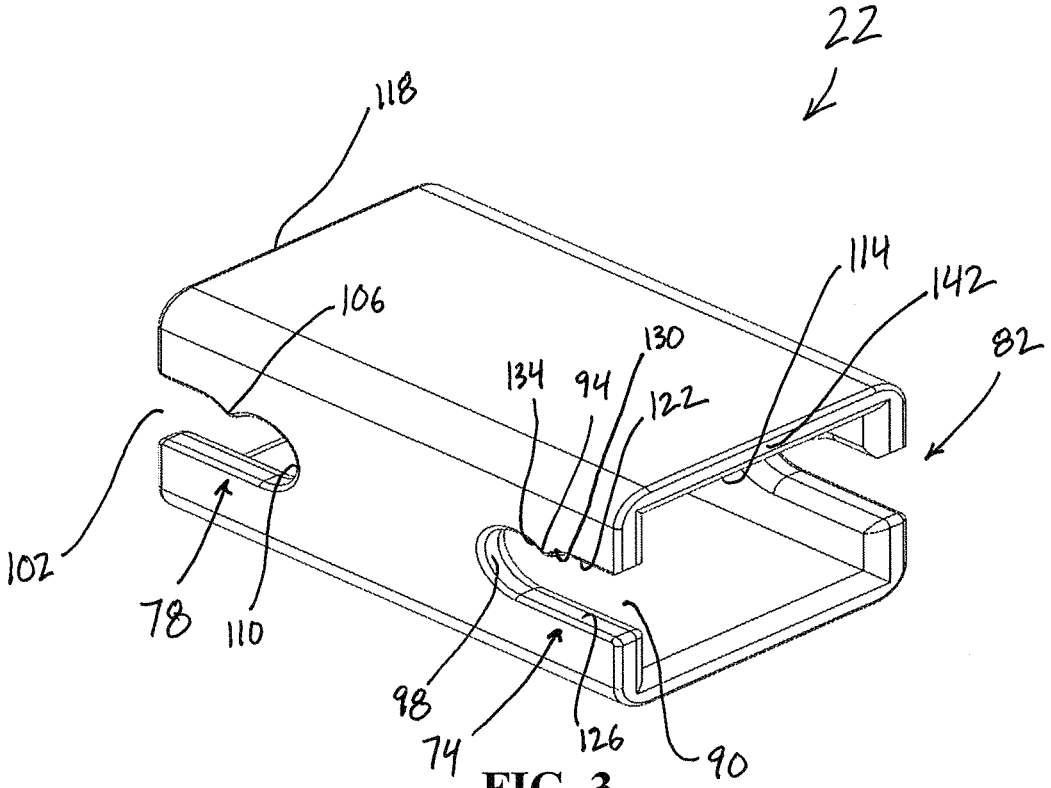
FIG. 3 is a perspective view of a connector of the connection of FIG. 1.
Figure 4:
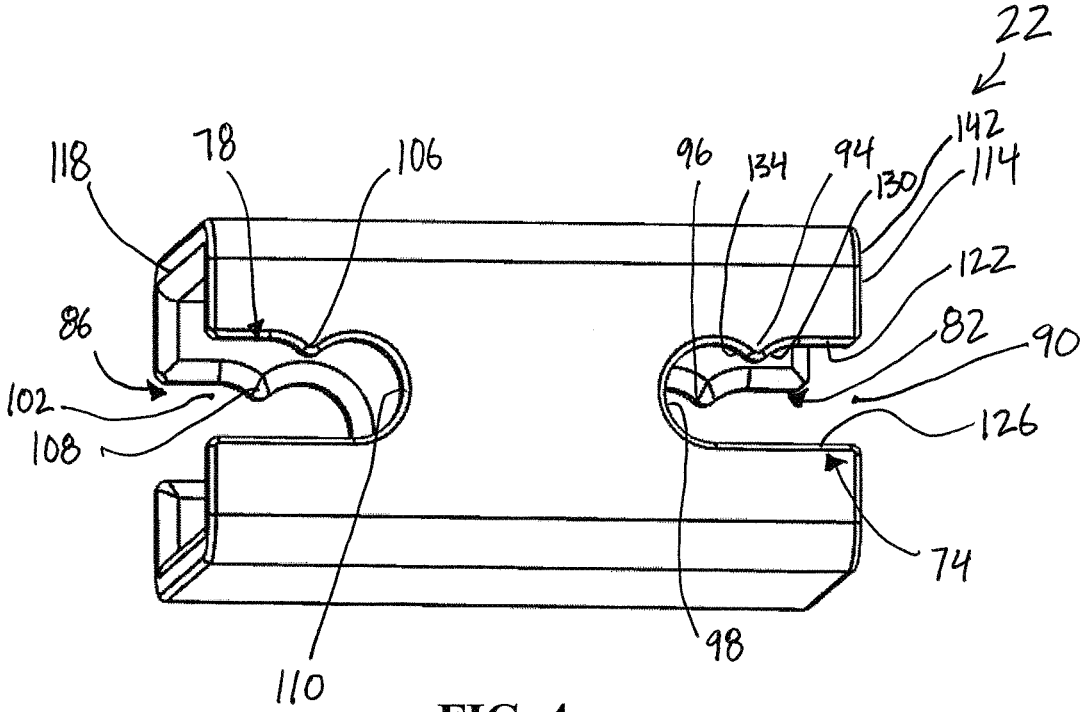
FIG. 4 is another perspective view of the connector of FIG. 3.

With reference to FIGS. 3, and 4, the connector 22 in the illustrated embodiment is a sleeve with a plurality of slots 74, 78, 82, 86. In particular, the connector 22 includes a first slot 74, a second slot 78, a third slot 82 positioned opposite the first slot 74, and a fourth slot 86 positioned opposite the second slot 78. The first slot 74 is configured to at least partially receive the first post 50. Likewise, the second slot 78 is configured to at least partially receive the second post 54. In the illustrated embodiment, the third slot 82 is configured to at least partially receive the third post 82 and the fourth slot 86 is configured to at least partially receive the fourth post 62.

With continued reference to FIGS. 3 and 4, the first slot 74 in the connector 22 includes a first opening 90, a first protrusion 94, and a first end 98 positioned opposite the first opening 90. Likewise, the second slot 78 includes a second opening 102, a second protrusion 106, and a second end 110 positioned opposite the second opening 102. In the illustrated embodiment, the third slot 82 has structure similar to the first slot 74 and the fourth slot 86 has structure similar to the second slot 78, and the details of third and fourth slots 82, 86 are not repeated herein for brevity.

With continued reference to FIGS. 3 and 4, the connector 22 is a sleeve with a first inlet aperture 114 configured to at least partially receive the first plug 14 and a second inlet aperture 118 positioned opposite the first inlet aperture 114. The second inlet aperture 118 is configured to at least partially receive the second plug 18. In the illustrated embodiment, the inlet apertures 114, 118 are rectangular-shaped. In the illustrated embodiment, the first opening 90 of the first slot 74 is formed as part of the first inlet aperture 114. In other words, the first opening 90 of the first slot 74 and the first inlet aperture 114 are in the same plane. Likewise, the second opening 102 of the second slot 78 is formed as part of the second inlet aperture 118.

With continued reference to FIGS. 3 and 4, the first slot 74 includes a first side portion 122 and a second side portion 126 positioned opposite the first side portion 122. The first and second side portions 122, 126 of the slot 74 extend between the first opening 90 and the first end 98. The first end 98 is arcuate and is shaped corresponding to the curvature of the first post 50. In the illustrated embodiment, the first protrusion 94 is positioned on the first side portion 122 and the second side portion 126 is planar. The first protrusion 94, in the illustrated embodiment, includes a first ramp surface 130 and a second ramp surface 134. The first ramp surface 130 is positioned closer to the first opening 90 than the second ramp surface 134. In the illustrated embodiment, the second slot 78, the third slot 82, and the fourth slot 86 each include similar structure as the first slot 74. In particular, the second slot 78 includes the protrusion 106, and the third slot 82 includes a protrusion 96, and the fourth slot 86 includes a protrusion 108.

With reference to FIG. 2, when the connection 10 is in the connected configuration (FIG. 2), the first post 50 is positioned within the first slot 74 and the second post 54 is positioned within the second slot 78. Likewise, the third and fourth post 58, 62 are positioned within the third and fourth slot 82, 86, respectively. Specifically, the first post 50 is positioned between the first end 98 and the first protrusion 94 of the first slot 74 and the second post 54 is positioned between the second end 110 and the second protrusion 106 of the second slot 78. In other words, the first post 50 is partially retained (i.e., held secure below a threshold force but released above the threshold force) within the first slot 74 by the first protrusion 94 in the connected configuration. To be placed in the connected configuration, the first post 50 moves past the first protrusion 94 in the first slot 74, causing the connector 22 to deflect in the process.

With reference to FIG. 1, when the connection 10 is in the disconnected configuration (FIG. 1) the first post 50 is removed from the first slot 74 and the second post 54 is removed from the second slot 78. In the illustrated embodiment, the first post 50 is removed from the first slot 74 in response to a threshold force being applied to the first plug 14. Likewise, the second post 54 is removed from the second slot 78 in response to a threshold force being applied to the second plug 18. In some embodiments, the threshold force is within a range of approximately 30 N and approximately 45 N. In some embodiments, the threshold force is approximately 35 N. In other embodiments, the threshold force is above 45 N or below 30 N. As such, the connection 10 is a break-away or quick-release locking connection. In other words, the first post 50 is spaced from the first protrusion 94 in the disconnected configuration. In some embodiments, only one of the plugs 14, 18 is separated from the connector 22 in a disconnected configuration while the other plug 14, 18 remains attached to the connector 22.

Forces applied to the first and second plugs 14, 18 that are below a threshold force and other minor disturbances, do not disconnect the connection 10 (i.e., the connection 10 remains in the connected configuration in response to forces below the threshold force). Forces applied to the first and second plugs 14, 18 that are above the threshold force, cause the connection 10 to move from the connected configuration (FIG. 2) to the disconnected configuration (FIG. 1). In other words, the connector 22 selectively retains the first plug 14 and the second plug 18 in the connected configuration such that forces below the threshold force do not inadvertently cause disconnection (i.e., to improve connection stability). In addition, the connector 22 selectively releases the first plug 14 and/or the second plug 18 to move to the disconnected configuration such that forces above the threshold force create disconnection to prevent a hazard (e.g., a trip hazard). As such, the connection 10 prevents damage to electrical cords connected to the plugs 14, 18 and mitigates trip hazards by providing a complete disconnect when the threshold force is applied while keeping the plugs 14, 18 held firmly together under normal operation when less than the threshold force is applied.

With reference to FIG. 1, the first plug 14 moves in a direction 146 along an insertion axis 138 as the first plug 14 moves between the disconnected configuration and the connected configuration. Likewise, the second plug 18 moves in a direction 150 along the insertion axis 138 as the second plug 18 moves between the disconnected configuration and the connected configuration. In the illustrated embodiment, the connector 22 is formed of an elastically deformable material. In some embodiments, the connector 22 is formed of an injection molded plastic (e.g., ABS). In other embodiments, the connector 22 may be formed of any suitable rigid plastic or metal.

In response to the first plug 14 moving between the connected configuration and the disconnected configuration, a portion 142 of the connector 22 deflects (i.e., elastically deforms). In the illustrated embodiment, the deflection of the portion 142 of the connector 22 is approximately orthogonal to the insertion axis 138. In other words, the portion 142 deflects away from the post 50 as the post 50 moves along the first ramped surface 130 in the first slot 74. The portion 142 returns to the original, undeflected position as the post 150 moves along the second ramped surface 134 in the first slot 74. As discussed above, the first post 50 is thereby selectively retrained in the first end 98 of the first slot 74 by the first protrusion 94. As such, the connector 22 deflects in the transition between the disconnected configuration and the connected configuration. A similar deflection of the portion 142 occurs when the first plug 14 is removed from the connector 22.

Various features and advantages are set forth in the following claims.

What is claimed is:

1. A connection comprising:

a first plug having a first post and a conductor;

a second plug having a second post and an aperture configured to receive the conductor;

a connector including a first slot and a second slot, the first slot includes a first opening, a first protrusion, and a first end opposite the first opening, and the second slot includes a second opening, a second protrusion, and a second end opposite the second opening;

wherein the first slot is configured to at least partially receive the first post and the second slot is configured to at least partially receive the second post; and wherein the first post is positioned between the first end and the first protrusion of the first slot, and the second post is positioned between the second end and the second protrusion of the second slot;

wherein the first slot includes a first side portion and a second side portion, the first side portion and the second side portion extend between the first opening and the first end;

wherein the first protrusion is positioned on the first side portion; and wherein the first protrusion includes a first ramp surface and a second ramp surface.

2. The connection of claim 1, wherein the first post is positioned between the first end and the first protrusion of the first slot and the second post is positioned between the second end and the second protrusion of the second slot when the connection is in a connected configuration; and wherein the first post is removed from the first slot in a disconnected configuration in response to a threshold force applied to the first plug.

3. The connection of claim 2, wherein the second post is removed from the second slot in the disconnected configuration in response to the threshold force applied to the second plug.

4. The connection of claim 2, wherein a portion of the connector deflects in response to the first plug moving between the connected configuration and the disconnected configuration.

5. The connection of claim 4, wherein the first plug moves along an axis as the first plug moves between the connected configuration and the disconnected configuration.

6. The connection of claim 5, wherein deflection of the portion of the connector is orthogonal to the axis.

7. The connection of claim 1, wherein the first end is arcuate.

8. The connection of claim 1, wherein the second side portion is planar.

9. The connection of claim 1, wherein the connector is a sleeve with a first inlet aperture configured to at least partially receive the first plug and a second inlet aperture positioned opposite the first inlet aperture, the second inlet aperture configured to at least partially receive the second plug.

10. The connection of claim 9, wherein the first opening of the first slot is formed as part of the first inlet aperture.

11. The connection of claim 1, wherein the connector is formed with an elastically-deformable material.

12. The connection of claim 1, wherein the first plug includes a first mating surface and the conductor extends from the first mating surface, and wherein the second plug includes a second mating surface and the aperture is formed in the second mating surface.

13. The connection of claim 12, wherein the first post is spaced from the first mating surface and the second post is spaced from the second mating surface.

14. The connection of claim 1, wherein the first plug and the second plug are DC power plugs.

15. The connection of claim 1, wherein the first plug includes a third post and the second plug includes a fourth post.

16. The connection of claim 15, wherein the connector includes a third slot configured to at least partially receive the third post and a fourth slot configured to at least partially receive the fourth post.

17. The connection of claim 16, wherein the third slot is positioned opposite the first slot and the fourth slot is positioned opposite the second slot.

18. A connection comprising:

a first plug having a first post and a conductor;

a second plug having a second post and an aperture configured to receive the conductor;

a connector including a first slot and a second slot, the first slot includes a first opening, a first protrusion, and a first end opposite the first opening, wherein the first end is arcuate, and the second slot includes a second opening, a second protrusion, and a second end opposite the second opening;

wherein the first slot is configured to at least partially receive the first post and the second slot is configured to at least partially receive the second post; and wherein the first post is positioned between the first end and the first protrusion of the first slot, and the second post is positioned between the second end and the second protrusion of the second slot.

19. The connection of claim 18, wherein the first slot includes a first side portion and a second side portion, the first side portion and the second side portion extend between the first opening and the first end.

20. The connection of claim 18, wherein the connector is a sleeve with a first inlet aperture configured to at least partially receive the first plug and a second inlet aperture positioned opposite the first inlet aperture, the second inlet aperture configured to at least partially receive the second plug.

21. The connection of claim 20, wherein the first opening of the first slot is formed as part of the first inlet aperture.

22. A connection comprising:

a first plug having a first post and a conductor;

a second plug having a second post and an aperture configured to receive the conductor;

a connector including a first slot and a second slot, the first slot includes a first opening, a first protrusion, and a first end opposite the first opening, and the second slot includes a second opening, a second protrusion, and a second end opposite the second opening;

wherein the first slot is configured to at least partially receive the first post and the second slot is configured to at least partially receive the second post; and wherein the first post is positioned between the first end and the first protrusion of the first slot, and the second post is positioned between the second end and the second protrusion of the second slot; and wherein the connector is a sleeve with a first inlet aperture configured to at least partially receive the first plug and a second inlet aperture positioned opposite the first inlet aperture, the second inlet aperture configured to at least partially receive the second plug.

23. The connection of claim 22, wherein the first opening of the first slot is formed as part of the first inlet aperture.

* * * * *